United States Patent [19]

Thiaville

[11] Patent Number: 4,969,665

[45] Date of Patent: Nov. 13, 1990

[54] WRITING PAD WITH HELIX CONFIGURATION

[75] Inventor: Charles M. Thiaville, Cazenovia, N.Y.

[73] Assignee: McAuliffe Paper, Inc., Liverpool, N.Y.

[21] Appl. No.: 356,539

[22] Filed: May 25, 1989

[51] Int. Cl.[5] ..... B42D 15/00

[52] U.S. Cl. ..... 283/114; 283/117; 283/36; 283/63.1; 281/51

[58] Field of Search ..... 283/114, 36, 63.1, 117; D19/1, 2, 6; 281/2, 5, 12, 14, 51, 15.1

[56] References Cited

U.S. PATENT DOCUMENTS 3,817,492 6/1974 Raymer .
4,166,152 8/1979 Baker et al. .
4,598,112 7/1986 Howard .

OTHER PUBLICATIONS

Exhibit 1, Photographed Swirl Pad, Photo Taken 12/4/89. Purchased at Sunset Specialties by Examiner. Sunset Specialties has been selling Swirl Pads Since 1969.

*Primary Examiner*—Douglas D. Watts
*Assistant Examiner*—Thomas Hamill, Jr.
*Attorney, Agent, or Firm*—Wall and Roehrig

[57] ABSTRACT

A writing pad containing a stack of horizontally aligned sheets, each of which is cut to the same size and shape. Initially, the sheets are stacked so that the corner edges of the stack are perpendicularly aligned with the top and bottom sheets. Preferably, the sheets in the stack are assembled in sets wherein each set is provided with a specific border color or colors which differ from the color or colors used in the other sets. The sheets are then fanned or swirled uniformly as to form helical flutes extending between the top and bottom sheet of the stack. An adhesive is applied to one side face of the stack to hold the stack in a swirled configuration. The top and bottom surfaces of each sheet are provided with a printed border that frames the writing area. By varying the colors printed on the different sets, a wide variety of visual effects can be obtained.

6 Claims, 2 Drawing Sheets

WRITING PAD WITH HELIX CONFIGURATION

BACKGROUND OF THE INVENTION

This invention relates to a writing pad having a helical stacked configuration which is bound along one helical side face to permit removal of the uppermost sheet or sheets from the stack and, in particular, to a writing pad wherein the sheets are swirled uniformly so that the corner edges of the stack form a helix.

In U.S. Pat. No. 3,817,492 to Raymer, there is described a note pad which is composed of stacked writing sheets. An adhesive is applied to the back vertical face of the stack to hold the sheets in assembly, while at the same time permitting one or more sheets to be torn from the top of the stack. The front wall or face of the stack is cut back at an angle so that the uppermost sheets in the stack are shorter than the lowermost sheets. An indicium is printed on the inclined front face of the stack so that some portion of the printed data extends a predetermined distance back from the front edge of each sheet onto the top surface thereof. The readability of the indicium is not destroyed as the individual sheets are removed from the stack. Accordingly, the above noted Raymer writing pad has the advantage of continually presenting printed information to the user even as the stack is diminished. The pad, however, is difficult to manufacture and assemble because each individual sheet in the stack must be cut to a different size and imprinted with different indicium than that carried by the other sheets.

OBJECTS AND SUMMARY OF THE INVENTION

It is therefore an object of the present invention to provide a writing pad having an attractive helical configuration in which the individual sheets forming the helix are cut to the same size and shape.

It is a further object of the present invention to provide a helical shaped pad that has a first appearance when seated in an upright position and a second appearance when seated in an inverted position.

Another object of the present invention is to provide a helical shaped writing pad having clearly discernable indicium printed adjacent to at least one swirled edge thereof.

Yet another object of the present invention is to provide a swirled note pad having inherently tacky elastomeric solvent-dispersable microspheres strategically located on the individual sheets to permit the sheets to be adhesively attached to other support surfaces once they are removed from the stack.

These and other objects of the present invention are attained by means of a writing pad containing a stack of horizontally aligned sheets, each of which is cut to the same size and shape. Initially, the sheets are stacked so that the corner edges of the stack are perpendicularly aligned with the top and bottom sheets. Preferably, the sheets in the stack are assembled in sets wherein each set is provided with a specific border color or colors which differ from the color or colors used in the other sets. The sheets are then fanned or swirled uniformly so that helical flutes are formed that rotate through about 180° between the top and bottom sheets in the stack. An adhesive is applied along one flute to hold the stack in a swirled configuration. The top and bottom surfaces of each sheet are provided with a printed border that frames the writing area. Primary sets of sheets contain a top border printed in a first color and a bottom border printed in a second color. When the swirled stack is viewed from the top side, it presents an entirely different appearance than when viewed from the bottom side. Interdispersed between the primary sets of sheets are interdispersed secondary sets of sheets containing top and bottom borders printed with selected colors that are different from the colors used in association with the primary sets. By varying the colors printed on the different sets, a wide variety of visual effects can be obtained.

In one form of the invention, indicium is printed on at least one fluted side face adjacent to a helical edge thereof. The printed material is placed on the stack face prior to swirling in a deformed posture so that when the sheets are fanned out in final assembly, the printed data becomes highly legible and easily readable.

In another form of the invention, inherently tacky elastomeric polymeric microspheres are coated onto a specific area on one side of each sheet prior to the stack being swirled. The coating is strategically located at the center of the sheet so that the microspheres remain relatively undisturbed as the sheets are fanned out in final assembly.

BRIEF DESCRIPTION OF THE DRAWINGS

For a better understanding of these and other objects of the present invention, reference will be made to the following detailed description of the invention which is to be read in conjunction with the following drawings, wherein.

DETAILED DESCRIPTION OF THE INVENTION

Figure 1:
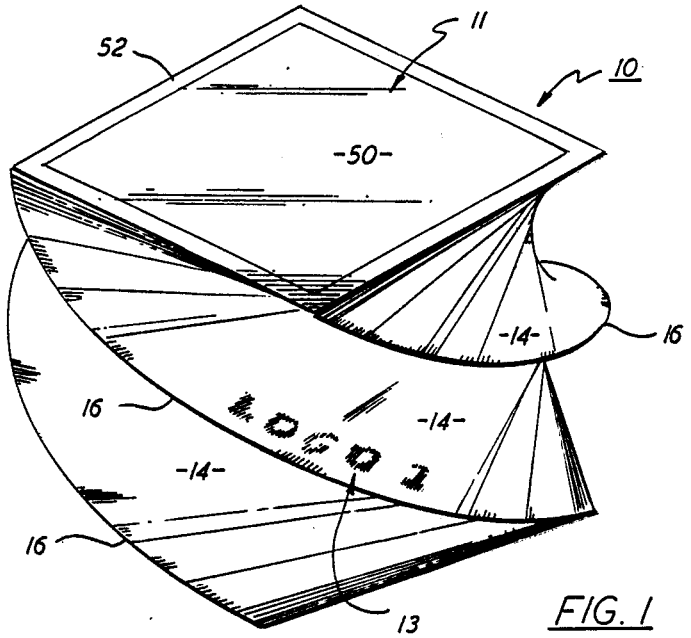
FIG. 1 is a perspective view of a helical shaped writing pad embodying the teachings of the present invention further illustrating indicium printed along one helical shaped corner of the pad.

Turning initially to FIG. 1 there is shown a helical shaped writing pad 10 embodying the teachings of the present invention. The pad contains a plurality of square cut sheets 11 that are held together by a suitable adhesive in the fanned or swirled configuration shown. As will be explained in greater detail below, the sheets are stacked in sets to provide the swirled pad with a multicolored eye-catching appearance. The pad is thus ideally well suited as a means of presenting promotional material of all types. The material may be in the form of printed numbers, letter designs, or a combination thereof. As illustrated in FIG. 1, the promotional material 13 is preferably printed upon at least one fluted surface 14 of the pad, and thereby reserving the top and bottom surfaces of the individual sheets for receiving written messages or the like. The top sheet or sheets can be separated from the stack so that messages written thereon can be disseminated, for example, within an office environment.

Figure 2:
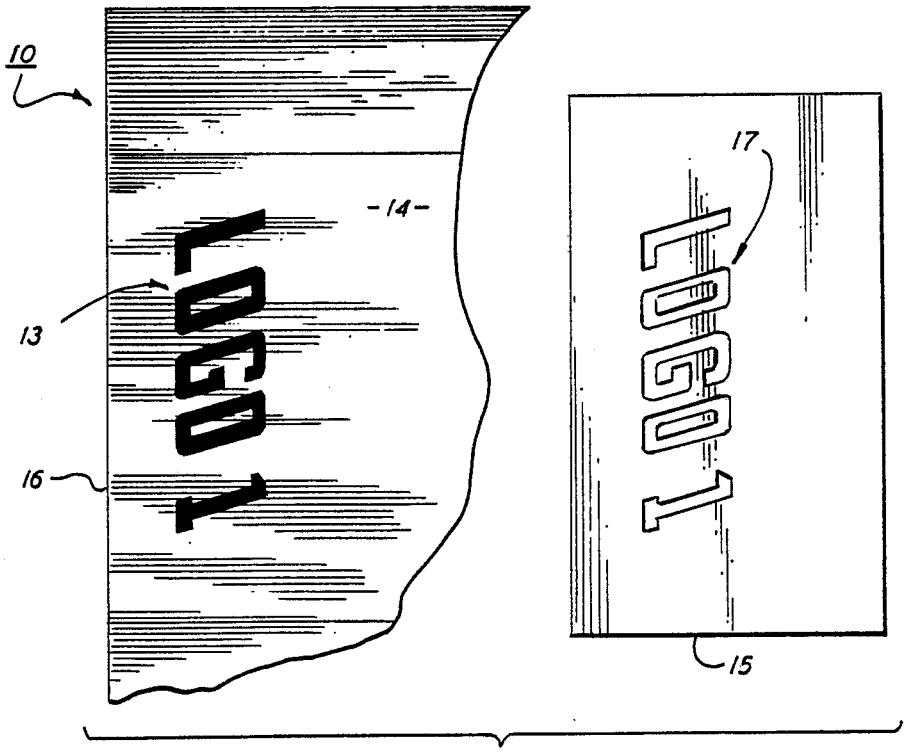
FIG. 2. is a partial front elevation showing a stack of sheets mounted in vertical alignment prior to the stack being swirled and further illustrating a template that is used in applying indicium along one corner of the stack.

Preferably, the indicium 13 is printed upon the fluted surface 14 prior to the stack being swirled and bound. The sheets 11—11 are initially stacked in vertical alignment as shown in FIG. 2 so that each corner 16 of the stack is perpendicular with the top and bottom sheet in the stack. In the present embodiment of the invention, a lettering template 15 is used to print the desired indicium on the surface 14 adjacent to the corner edge 16. It should be clear, however, that any suitable printing technique may be used to place the desired information on the pad. Template 15 has a replica 17 of the desired image cut therein. The template is laid against the now flat side face adjacent to and in close proximity with the vertical corner edge 16 and the image stenciled onto the face through the template. The image is printed in a slightly distorted form so that when the stack is swirled into a helical configuration, the printed image will assume its desired shape or form.

Although in the present embodiment of the invention the indicium 16 is shown printed adjacent to one corner edge of the stack, it should be obvious to one skilled in the art it can be printed on either side of all corner edges so that it will be easily discernable from all sides whether the pad is in an upright or an inverted position.

Figure 7:
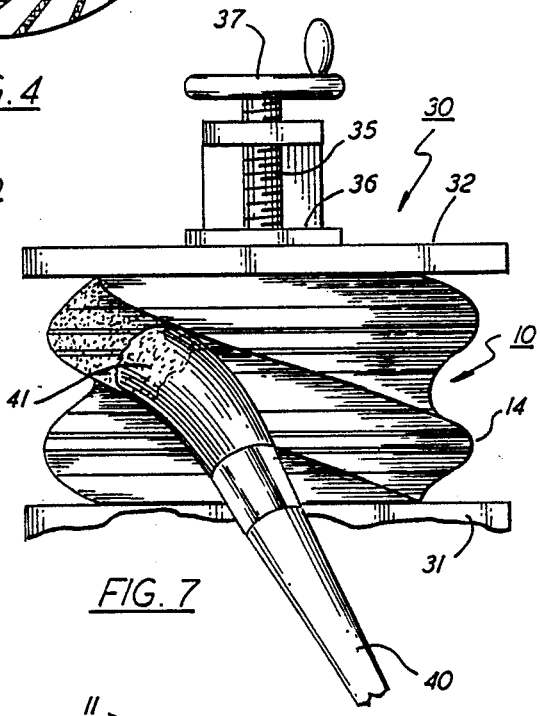
FIG. 7 is a side elevation showing an adhesive being applied to one helical side face of the stack.

The unbound vertically aligned pad with the slightly distorted image shown in FIG. 2 is swirled or twisted into a helical shape either manually or by machine operation so that each corner edge of the top sheet is turned uniformly through about 180 degrees relative to the bottom sheet. This, as noted above, causes the individual sheets to be progressively fanned out an incrementally lesser degree of rotation from top to bottom and the side faces of the stack become concave in form. Once the desired shape is attained, the swirled but still unbound stack is placed in a holding fixture 30 as shown in FIG. 7. The fixture includes a fixed base plate 31 and a movable top plate 32 which is threadably supported within a yoke 33 over the base plate. The movable top plate 32 is connected to a lead screw 35 by means of a swivel connector 36. The lead screw, in turn, is threaded through the yoke and is equipped at its proximal end with a circular crank 37 which can be turned in either direction to raise or lower the movable plate in reference to the fixed base plate.

In practice, the unbound pad is clamped between the two plates of the holding fixture under a slight pressure to flatten the individual sheets one against the other. A bonding adhesive of any suitable type known and used in the art is then applied to one helical concave side face of the stack to hold the sheets in the swiveled configuration. The adhesive can be applied by means of a brush 40 having specially contoured bristles 42 which complement the concave shape of the side face. Alternatively, the adhesive can be applied automatically by means of a suitable mechanical applicator. The swirled pad is allowed to remain in the clamping fixture until such time as the adhesive has cured.

Figure 4:
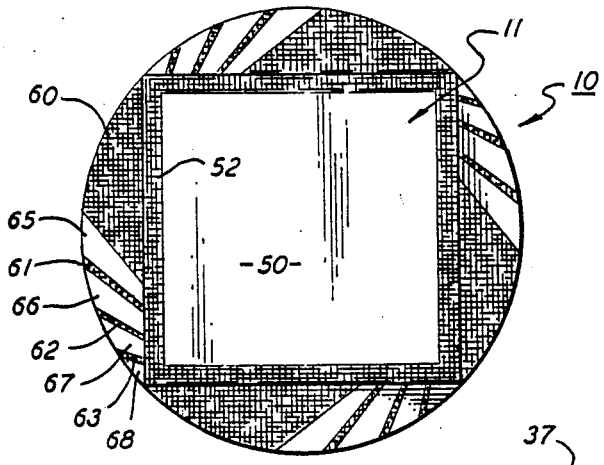
FIG. 4 is a top plan view of a swirl stack wherein a first primary color predominates when the stack is viewed from the top side thereof.
Figure 3:
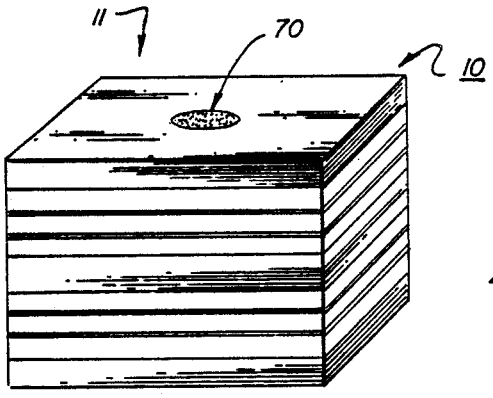
FIG. 3 is a perspective view of an unswirled stack showing the sheets stacked in preselected sets or groups.
Figure 6:
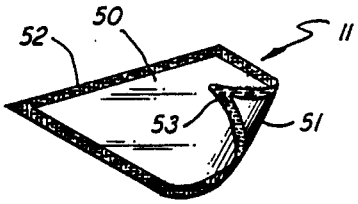
FIG. 6 is an individual sheet that has been removed from the stack further illustrating the color border regions printed on the opposing surfaces thereof.
Figure 5:
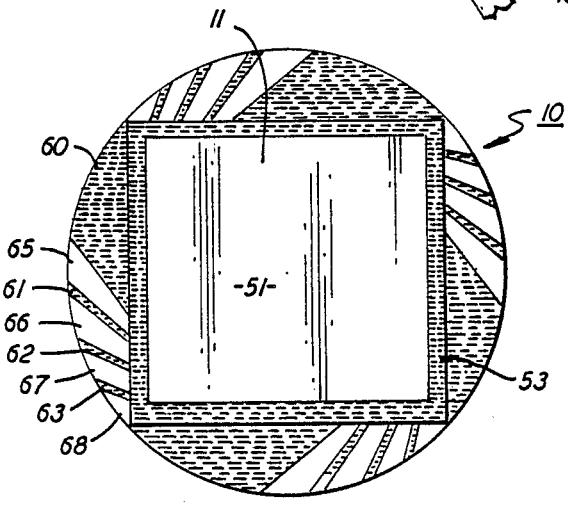
FIG. 5 is a bottom view of a swirled stack shown in FIG. 4 wherein a second primary color predominates when the stack is viewed from the bottom side thereof.

Referring now to FIGS. 3–6, in a further embodiment of the invention the individual sheets 11 of the pad are dye cut from larger blanks of writing material to a uniform size and shape. The top surface 50 and the bottom surface 51 of the individual sheets are both provided with a printed border 52 and 53, respectively, which completely surrounds the outer peripheral region of the sheet surface (FIG. 6). The top border and the bottom border can be printed from the same color or from different colors, depending upon the visual effect that is desired. As best seen in FIGS. 4 and 5, when the sheets are fanned out in the swirling operation, the colored frame regions become extended and thus, highly visible.

In this particular embodiment of the invention, the sheets are stacked in prearranged sets, one over the other. The sheets, in what will herein be referred to as the primary sets 60–63, are printed on the top surface with a gold border 52 and on the bottom surface with a gray border 53. The intermediate or secondary sets 65–68 of sheets are interdispersed between the primary sets. The secondary sets may also contain printed borders on one or both sides of the sheets. Preferably, the borders on both sides of the sheets in the secondary sets are printed in the same color, a color which is different from that used in the other sets. Accordingly, when the swirled pad is generated, the primary color gold will predominate when the pad is viewed from one side, that is, the upright position. However, when the pad is turned over or inverted, the second primary color gray will predominate and thus give the pad an entirely different appearance. The remaining secondary color sets are periodically dispersed in a desired pattern between the primary color sets to provide an extremely pleasant and eye-catching arrangement.

Although not shown in this particular embodiment of the invention, indicia can be printed along the corner margins of the pad, as explained above. Again, the indicium can be printed in any desired color and format to further enhance the aesthetic value of the pad, while at the same time presenting the printed data in a readily perceivable form.

Turning once again to FIG. 3, the sheets in each set can be further provided with an adhesive patch 70 that is coated onto one side thereof. The patch contains inherently tacky elastomeric, solvent-dispersable, solvent-insoluble, polymeric microspheres. As explained in greater detail in U.S. Pat. Nos. 4,598,121 to Howard and 4,166,152 to Baker, this type of reusable adhesive material is coated onto the sheets in a aqueous form and then dried in a forced-air oven to provide a repeatable reusable adhesive. Accordingly, when the individual sheets are removed from the pad they can be adhered to any type of suitable support surface by pressing the adhesive area with sufficient force to rupture at least some of the microspheres. The patches are preferably placed at the center of the individual sheets where they are least likely to be disturbed as the pad is being swirled into a helix. Although some of the microspheres may rupture during the swirling operation, the patches will retain their ability to be re-adhered to a wide variety of support surfaces if care is taken not to apply an excessive holding force to the stack.

Although the present invention is illustrated with regard to square dye cut sheets, the sheets can take any desired form. For example, the individual sheets can have as many sides as desired and the sides can be either linear or arcuate so as to depict any number of geometric shapes. It should also be evident from the present disclosure that regardless of the form of the individual sheets, the pads produced by the present swirling operation provide an extremely pleasing article that draws immediate attention to any promotional material displayed thereon. Accordingly, the pads are ideally suited for a means of promoting any type of goods and/or services.

While this invention has been explained with reference to the structure disclosed herein, it is not confined to the details as set forth and this application is intended to cover any modifications and changes as may come within the scope of the following claims.

What is claimed is:

1. An article of manufacture that includes a plurality of non-circular sheets of the same size and shape vertically stacked in registration one on top of the other, said stack including a top sheet, a bottom sheet, and a plurality of intermediate sheets positioned therebetween, readable indicium printed in distorted form along at least two adjacent vertical faces of the stack with one indicium being in reverse reading orientation relative to the other indicium, said sheets in said stack being rotated incrementally with each increment increasing an equal amount from the top to the bottom sheet to form a twisted configuration having uniformly concave helical-shaped sides separated by helical edges that rotate through at least 180° from the top sheet to the bottom sheet, said distorted indicium being rotated to a readable form along one helical edge so that one of the indicium is clearly readable when the stack is seated upon either the top or the bottom sheet;

adhesive means along a helical side of the stack that is free of said indicium to hold the stack in said twisted configuration to permit individual sheets to be removed from the stack, and tacky elastomeric, polymeric microspheres coated upon a specific region of each sheet to minimize rupturing of said microspheres as the sheets are rotated so that each sheet can be further adhered to a support surface upon removal from the stack.

2. The article of manufacture of claim 1 wherein the microspheres are located at about the center of each sheet on the back surface thereof.

3. The article of manufacture of claim 2 wherein each sheet has a printed border on each side of the sheet about the outer periphery surrounding a central writing area, the printed border on the top side of each sheet being of a color different from that on the bottom side of said sheet whereby the stack provides a different visual display when seated upon the top sheet than when seated upon the bottom sheet in said stack.

4. An article of manufacture that includes a plurality of non-circular sheets of the same size and shape that are stacked vertically, said stack including a top sheet, a bottom sheet and a plurality of intermediate sheets therebetween, said sheets in the stack being rotated incrementally with each increment increasing an equal amount from the top sheet to the bottom sheet to form a twisted configuration having uniform concave helical sides separated by helical edges that extend through at least 180° between the top sheet and bottom sheet in the stack, adhesive means along one helical side of the stack for holding the stack in said twisted configuration to permit individual sheets to be removed from the stack, and tacky elastomeric, polymeric microspheres coated upon a specific region of each sheet to minimize rupturing of the sphere as the sheets are rotated into the twisted configuration whereby each sheet can be further adhered to a support surface after it is separated from the stack.

5. The article of manufacture of claim 4 wherein the microspheres are located in a region at about the center of each sheet.

6. The article of manufacture of claim 5 that further includes readable indicium on either side of at least one helical edge that is printed in a distorted form along said edge prior to rotation of said sheets so that the indicium is in a readable form after rotation of said sheets.

* * * * *